United States Patent [19]

Blain

[11] Patent Number: 4,549,861

[45] Date of Patent: Oct. 29, 1985

[54] ROTATING POSITIVE DISPLACEMENT SCROLL APPARATUS WITH LUBRICATING PUMP

[75] Inventor: Edward S. Blain, Rockford, Ill.

[73] Assignee: Sundstrand Corporation, Rockford, Ill.

[21] Appl. No.: 626,537

[22] Filed: Jun. 28, 1984

[51] Int. Cl.[4] ..... F01C 1/04; F01C 19/08; F01C 21/04; F04D 1/12

[52] U.S. Cl. ..... 418/55; 418/88; 418/188; 415/89

[58] Field of Search ..... 418/55, 88, 188; 415/89

[56] References Cited

U.S. PATENT DOCUMENTS 958,768 5/1910 Richardson ..... 415/89
3,318,644 5/1967 Johnson ..... 415/89
3,601,514 8/1971 Afner ..... 418/188
3,884,599 5/1975 Young et al. ..... 418/55

FOREIGN PATENT DOCUMENTS 409130 2/1945 Italy ..... 415/89

*Primary Examiner*—John J. Vrablik
*Attorney, Agent, or Firm*—Wood, Dalton, Phillips, Mason & Rowe

[57] ABSTRACT

A positive displacement machine including first and second scrolls having interfitting vanes adapted to define at least one traveling pocket. One of the scrolls has a central outlet and a hollow shaft mounts the scroll for rotation. A machine housing contains the scrolls and the shaft and has an outlet port. A transfer tube is stationarily mounted in the housing in fluid communication with the port and extends into one end of the shaft. A seal seals the interface of the transfer tube and the shaft.

11 Claims, 3 Drawing Figures

ROTATING POSITIVE DISPLACEMENT SCROLL APPARATUS WITH LUBRICATING PUMP

FIELD OF THE INVENTION

This invention relates to a positive displacement apparatus of the type having two interfitting scrolls, and more particularly, to a shaft seal and to an oil pump useable in such apparatus.

BACKGROUND OF THE INVENTION

Prior art of possible relevance includes the following U.S. Pat. Nos. 4,343,599 issued Aug. 10, 1982 to Kousokabe; 4,340,339 issued July 20, 1982 to Hiraga et al; 3,802,809 issued Apr. 9, 1974 to Vulliez; 4,332,535 issued June 1, 1982 to Terauchi et al; 4,065,279 issued Dec. 27, 1977 to McCullough; 4,314,796 issued Feb. 9, 1982 to Terauchi; 4,365,941 issued Dec. 28, 1982 to Tojo et al; 4,350,479 issued Sept. 21, 1982 to Tojo et al; and 4,129,405 issued Dec. 12, 1978 to McCullough.

As evidenced by the above identified patents, over the years there have been a number of proposals of positive displacement apparatus of the scroll type, frequently, but not always, for use as compressors in refrigeration systems. Though theoretically practical, they have not been commercialized to any significant extent due to a variety of problems including sealing and lubricating difficulties.

The present invention is directed to overcoming one or more of the above problems.

SUMMARY OF THE INVENTION

It is the principal object of the invention to provide a new and improved positive displacement apparatus of the scroll type. More specifically, it is an object of the invention to provide such a positive displacement apparatus with (a) an improved oil pumping system for lubricating purposes and/or (b) improved sealing means for the high pressure zones in the apparatus.

According to one aspect of the invention, a positive displacement machine is provided having first and second scrolls with interfitting vanes adapted to define at least one fluid receiving pocket movable between a radially inner port and a radially outer port upon rotary translation of one of the scrolls relative to the other. Means including at least one rotary shaft mount the scrolls for rotation and rotary translation. An annular pump housing is affixed to the shaft for rotation therewith and includes an inlet through which lubricant may be introduced into the housing. A stationarily mounted lubricant pick-up tube is disposed within the housing and has an open end facing oppositely of the intended direction of rotation of the shaft. Means are provided which are in fluid communication with the pick-up tube for conveying lubricant picked up by the tube to a point of use within the machine.

According to this aspect of the invention, a drain may be provided in the housing radially inwardly of the open end of the pick-up tube for allowing lubricant and contaminants therein to exit the housing when the shaft is not being rotated.

This aspect of the invention further contemplates a machine housing containing the scrolls, the mounting means and the annular housing as well as the pick-up tube and further defining a lubricant sump which is in fluid communication with the inlet to the annular housing. The inlet to the housing comprises an annular opening in the annular housing and the pick-up tube is mounted on the machine housing and extends axially into the annular pump housing through the annular opening. The portion of the pick-up tube within the pump housing is curved so as to be insertable thereinto through the annular opening and the pick-up tube is further mounted on the machine housing for limited rotation so that the open end of the pick-up tube may be moved between a radially inner position aligned with the annular opening for assembly purposes and a radially outer position wherein the open end of the pick-up tube is radially outwardly of the drain.

According to another aspect of the invention, there is provided a positive displacement machine having first and second scrolls with interfitting vanes adapted to define at least one traveling pocket in which fluid may be received. One of the scrolls has a central outlet and means including a hollow shaft mount the scrolls for rotation such that one end of the hollow shaft is connected to the one scroll about the outlet. A machine housing contains the scrolls and the mounting means and has an outlet port. A transfer tube is stationarily mounted in the housing in fluid communication with the outlet and extends into the other end of the shaft. Means seal the interface of the transfer tube and the shaft.

A preferred embodiment of the invention provides that the outer diameter of the transfer tube is sufficiently less than the inner diameter of the shaft such that an annular space exists therebetween. The sealing means is guided by the transfer tube into sealing engagement with the adjacent end of the shaft and means are disposed in the annular space for defining a pumping configuration which is responsive to rotation of the shaft relative to the tube for directing lubricant through the annular space toward the sealing means.

According to the invention, a bellows may surround the transfer tube and is employed for urging the sealing means toward the shaft end which it abuts.

Other objects and advantages will become apparent from the following specification taken in connection with the accompanying drawings.

DESCRIPTION OF THE PREFERRED EMBODIMENT

Figure 1:
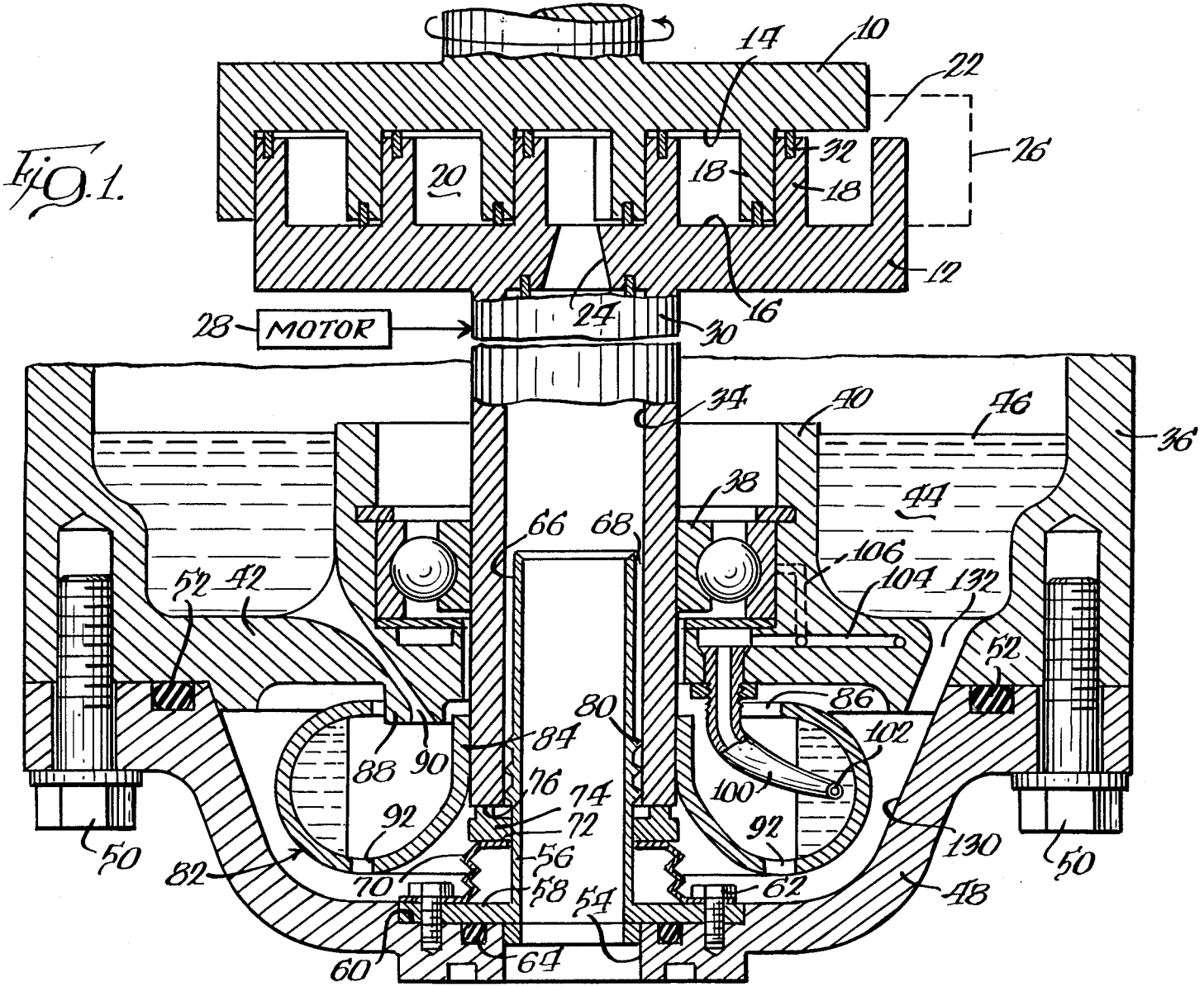
FIG. 1 is a sectional view of a positive displacement apparatus of the scroll type made according to the invention.

An exemplary embodiment of a positive displacement scroll apparatus made according to the invention is illustrated in FIG. 1 and is in the form of a scroll compressor of the type wherein both scrolls are rotated, with one scroll in addition being translated in a rotary fashion relative to the other. However, it will be appreciated by those skilled in the art that the invention is not limited to positive displacement apparatus acting as compressors, but may be utilized with efficacy in positive displacement machines operating as pumps, expanders or the like.

The scroll compressor includes first and second scrolls 10 and 12 respectively having facing faces 14 and 16 respectively. The faces 14 and 16 are generally parallel and each mounts a scroll wrap or vane 18. The vanes 18 on the scrolls 10 and 12 interfit to define an interface between the two which, as is well known, includes at least one fluid receiving, traveling pocket 20 in which the fluid to be acted upon, is received. The pockets 20, as is well known, move between radially inner positions and radially outer positions. When the apparatus is used as a compressor, a point 22 adjacent the peripheries of the scrolls 10 and 12 at the interface of the same opens to define an inlet. Generally centrally of the scroll 12 is an opening 24 which defines an outlet and in this case, the pockets 20 move radially inwardly from the inlet 22 to the outlet 24 to compress fluid. To achieve this, the vanes 18 are conventionally formed according to, for example, the teachings of the previously identified patents. Means 26, shown schematically, of conventional configuration are utilized to connect the scrolls 10 and 12 such that when the scroll 12 is rotated as by a motor 28 driving a shaft 30, the scroll 10 will rotate therewith, but about parallel, offset axis.

To prevent leakage during the compression process, the vanes 18 may be provided with tip seals as are shown at 32.

According to the invention, the shaft 30 is hollow, its inner diameter being shown at 34 and such is in fluid communication with the outlet 24 formed in the scroll 12. The shaft 30 extends downwardly within a housing 36 for the machine to be journalled in bearings 38 set in an annular flange 40 extending upwardly from a web 42 forming part of the housing 36. These components also serve to define a sump area 44 which receives lubricant, typically oil 46, for lubrication purposes.

The housing 36 also includes a cap 48 secured and sealed to the web 42 oppositely of the sump 44 as by bolts 50 and seals 52. The cap 48 includes an outlet port 54 which is axially aligned with the shaft 30. A transfer tube 56 has a radially extending flange 58 received in a recess 60 in the cap 48 and is secured thereto as by screws 62 and sealed thereagainst by an O-ring 64. The transfer tube has an outer diameter 66 which is somewhat less than the inner diameter 34 of the shaft 30 such that, as an end of the transfer tube 56 extends into the hollow of the shaft 30, an annular space 68 exists between the shaft 30 and the transfer tube 66.

Surrounding the transfer tube 56 and mounted to the cap 48 by the screws 62 is a bellows 70. The bellows 70 is in a compressed state and includes a flat surface 72 which engages and seals against the underside of a flat seal 74. The flat seal is circular and is disposed about the transfer tube 56 to be guided along the axis of the machine thereby. The upper surface of the flat seal 74 sealingly engages the end 76 of the shaft 30 remote from the outlet 24. Good sealing contact is maintained by the urging of the flat seal 74 against the end 76 by the bellows 70.

As is well known, when such devices are utilized as compressors, lubricant is frequently introduced at or near the inlet 22 to minimize the friction involved in the near contact of the vanes 18 with each other as well as to lubricate the tip seals 32. Since such lubricant must necessarily exit the interface of the scrolls 10 and 12 through the outlet 24, it will be found within the interior of the shaft 30. Because the shaft 30, during operation of the device, will be rotating, and such rotation will impart a rotary motion to the exiting mixture of compressed gas and lubricant, the lubricant will tend to be flung by centrifugal force against the inner diameter 34 of the shaft 30. Such lubricant may travel down the shaft's inner diameter 34 to enter the space 68. A pumping configuration which may be in a form approximating coarse threads may be carried on the exterior of the transfer tube 56 for pumping purposes. The threads 80 are pitched such that upon relative rotation between the shaft 30 and the stationary transfer tube 56, the lubricant will be conveyed downwardly to the seal 74 where it will lubricate the interface of the various components engaged by the seal 74 so as to provide good sealing and minimize wear.

This facet of the invention, when the apparatus is used as a compressor, confines high pressure gas to the interior of the shaft 34 and the transfer tube 56. At no time, is the high pressure gas applied against any appreciable portion of the housing 36 as in various other compressor applications known in the art. As a consequence, the housing 36 can be made with lesser strength requirements providing a material savings.

For lubricating other components of the apparatus, a unique pump may be employed.

The pump includes an annular housing, generally designated 82, which is generally toroidal in shape. At its inner diameter 84, the housing 82 is secured to the shaft 30 adjacent the end 76 by any suitable means such as brazing. Consequently, the housing 82 will rotate with the shaft 30 when the apparatus is energized. At its radially inner, upper end, the housing 82 is provided with an annular inlet 86 which extends about the entire toroid defined by the housing 82. A lug 88 formed on the underside of the web 42 may extend into the housing 82 through the annular inlet 86 and includes a port 90 extending to the sump 44. As a consequence, oil 46 within the sump 44 may drain into the housing 82.

Oppositely of the annular inlet 86, the lowermost portion of the housing 82, at a location that is intermediate its radially inner and radially outer extremities is provided with a series of drain apertures 92. It will be appreciated that during rotation of the shaft 30, lubricant introduced into the housing 82 via the conduit 90 and the inlet 86 will be acted upon by centrifugal force and tend to move toward the radially outer extremities of the housing 82. The location of the drain holes 92 thus controls the depth of the annular body of lubricant that results from such centrifugal force.

It will also be appreciated that when the apparatus is de-energized, the drain holes 92 allow any lubricant that remains within the housing 82 to drain into the cap 48. Such drainage is highly desirable since any contaminants in particulate form will be carried by the draining lubricant out of the housing 82 to settle within the cap 48 out of the path of lubricant travel as will be seen.

A pick-up tube 100 is disposed within the housing 82 and includes an open end 102 opening in a direction opposite the direction of rotation of the shaft 30. The open end 102 is also located radially outwardly of the drain holes 92 so as to be within the annular body of lubricant within the housing 82 that forms when the shaft 30 is being rotated. At the same time, the open end 102 is spaced somewhat radially inwardly from the housing 82 itself so as to avoid contact therewith and to avoid the entry into the end 102 of any particulate material subject to centrifugal force during such operation, which, due to a density greater than that of the lubricant, will typically be radially outermost of the material within the pump housing 82.

The pick-up tube 100 is in fluid communication with one or more lubricant passages 104 formed at desired locations in the housing 36. Such passages may extend to, for example, the bearings 38 as shown in dotted lines at 106 to lubricate the same. Alternatively, or additively, they may extend to other bearings (not shown), to the interface of the vanes 10 and 12, to the connecting linkage 26, or any other components requiring lubrication.

Figure 2:
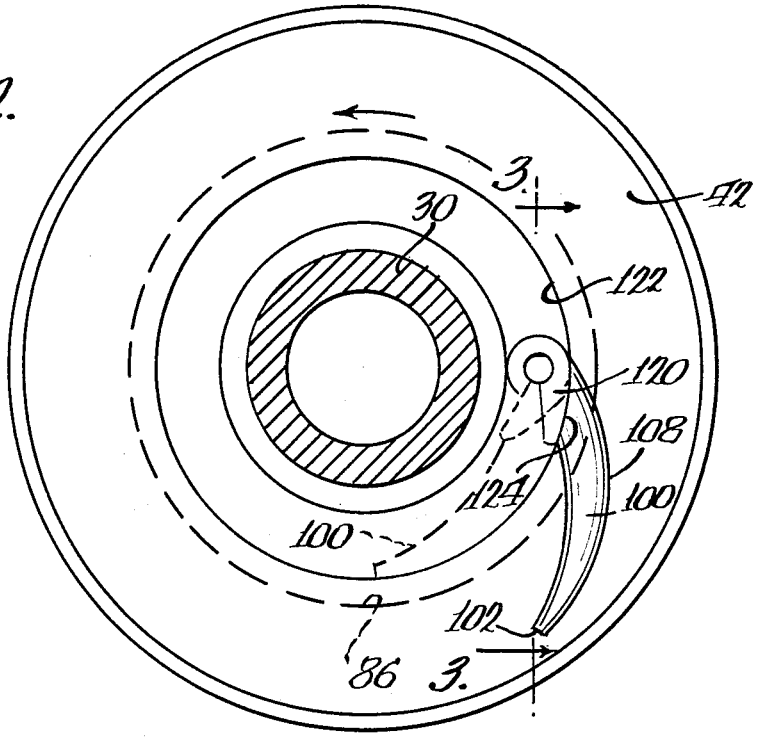
FIG. 2 is a somewhat schematic view of a lubricant pump construction.
Figure 3:
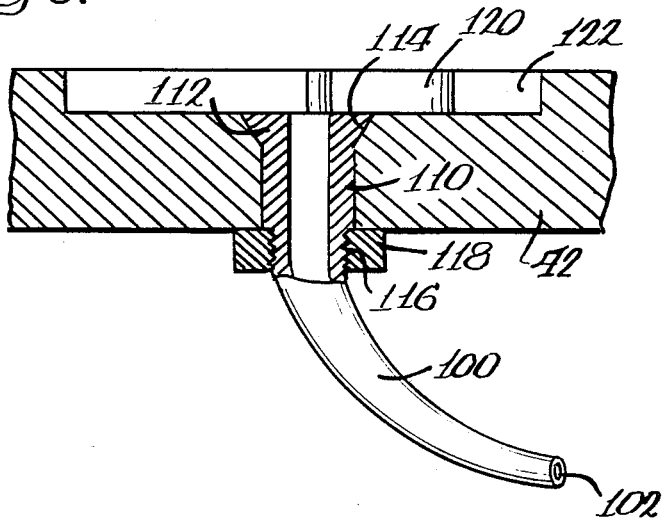
FIG. 3 is an enlarged sectional view taken approximately along the line 3—3 in FIG. 2.

The pick-up tube 100 is mounted on the housing 36 within the same, and as shown in FIG. 1, is so mounted to the web 42. As best seen in FIGS. 2 and 3, the pick-up tube 100 includes a lower end 108 which is curved and this curvature will generally be such to the radius of the curvature will be equal to or less than the radius of the annular opening 86. This serves to facilitate assembly as will be seen.

The upper end of the pick-up tube 100 is straight and extends generally axially from the web 44 as shown at 110. The same may terminate in an inverted, frustoconical head 112 received in a countersunk bore 114 in the web 42. The lower end of the upper portion 110 may be threaded as at 116 so as to receive a nut 118 by which the pick-up tube 100 may be firmly secured to the web 42.

A tongue 120 is affixed by any suitable means to the head 112 of the pick-up tube 100 and is received in a recess 122 in the upper surface of the web 42. The radially outer side of the recess 122 is configured in connection with the tongue 120 so as to allow limited rotation of the pick-up tube about an axis defined by its upper end 110.

The two extremes of movement are shown for example in FIG. 2 which purposely is not a technically accurate depiction of the structure in order to illustrate more advantageously the operation of the mechanism. The web 42 and recess 120 therein are accurately shown and the radially outer periphery of the annular inlet 86 is depicted by a dotted line bearing the designation 86. It will be appreciated that the vast majority of the pick-up tube will thus be hidden from view by the web 42 but nonetheless, the same in its operative position is shown in solid lines and given the designation 100. In this position, it will be observed that a side 124 of the tongue 120 is brought into contact with a side of the recess 122 such that the end 102 of the pick-up tube 100 cannot be moved further radially outwardly. Thus, this configuration assures proper positioning of the end 102 of the pick-up tube 100 for operational purposes.

It will also be appreciated that by rotating the assemblage in a clockwise direction as viewed in FIG. 2, the pick-up tube may be made to assume the dotted line position. It will be seen that in this position, all components of the pick-up tube 100 are located radially inwardly of the radially outer periphery of the annular inlet 86.

Accordingly, for assembly purposes, with the cap 48 removed, the pick-up tube 100 may be moved to the dotted line position shown in FIG. 2. The annular pump housing 82 may then be moved axially onto the shaft 30 and about the pick-up tube 100 and then secured in place. By engaging the head 112 of the pick-up tube 100 or the tongue 120 associated therewith, the pick-up tube 100 may then be rotated to the solid line position illustrated in FIG. 2. Thereafter, the bearing 38 may be assembled in the location illustrated in FIG. 1 and the remaining assembly details attended to.

To prevent buildup of lubricant exiting the housing 82 via the drain openings 92 within the cap 48, the latter has an inner surface 130 (FIG. 1) which slopes radially outwardly toward a return conduit 132 extending to the sump 44. During operation of the apparatus, such lubricant as may build up within the cap 48 exteriorly of the pump housing 82 to the point where it engages the same will have rotary motion imparted thereto by such engagement. The rotary motion will of course create a centrifugal force causing the lubricant to move radially outwardly up the sloping surface to be returned to the sump 44 via the conduit 32 since the resisting head of lubricant 46 in the sump 44 will be minimal. In the typical case the lower extremity of the housing 82 will be sufficiently above the upper surface of the cap 48 such that particulate contaminants resting on the latter will not be affected by such pumping action.

From the foregoing, it will be appreciated that a positive displacement apparatus made according to the invention simply and inexpensively solves the sealing and lubrication problems encountered in the prior art. The unique pumping configuration 80 at the interface of the transfer tube 56 in the hollow shaft 30 assures adequate lubrication of the seal 74 so as to provide long life. The oil pump including the transfer tube 100 is simple and reliable and uniquely avoids any possibility of the pick-up of particulate contaminants and the conveying of same to points requiring lubrication where they could accelerate wear.

I claim:

1. A positive displacement machine comprising:

first and second scrolls having interfitting vanes adapted to define at least one travelling pocket in which a fluid may be received, one of said scrolls having a central outlet;

means, including a hollow shaft, mounting said scrolls for rotation, one end of said hollow shaft being connected to said one scroll about said outlet;

a machine housing containing said scrolls and said mounting means and having an outlet port;

a transfer tube stationarily mounted in said housing in fluid communication with said outlet port and extending into the other end of said shaft; and means sealing the interface of said transfer tube and said shaft, the outer diameter of said transfer tube being sufficiently less than the inner diameter of said shaft so that an annular space exists therebetween; and said sealing means being guided by said transfer tube into sealing engagement with said shaft other end;

means in said annular pace defining a pumping configuration responsive to rotation of said shaft relative to said tube for directing lubricant from a lubricant source through said annular space toward said sealing means.

2. The positive displacement machine of claim 1 further including a bellows surrounding said transfer tube and urging said sealing means toward said shaft other end.

3. The positive displacement machine of claim 2 further including a toroidal shaped pump housing secured to said shaft for rotation therewith, a radially inner inlet for said pump housing, a radially intermediate drain for said pump housing, and a radially outer, stationarily mounted pickup tube within said pump housing and opening oppositely of the intended direction of rotation of the shaft.

4. The positive displacement machine of claim 3, wherein said machine housing includes a lubricant sump in fluid communication with said radially inner inlet; said mounting means includes at least one bearing; and means establishing fluid communication between said bearing and said pick-up tube.

5. The positive displacement machine of claim 4 wherein said radially inner inlet comprises an annular opening in said pump housing and said pick-up tube is mounted on said machine housing and extends axially into said pump housing through said annular opening.

6. The positive displacement machine of claim 5 wherein the portion of the pickup tube within said pump housing is curved so as to be insertable thereinto through said annular opening and said pick-up tube is further mounted on said machine housing for limited rotation so that said portion may be moved between a radially inner position aligned with said annular opening for assembly purposes and a radially outer position wherein the opening of said pick-up tube is radially outwardly of said drain.

7. A positive displacement machine comprising:

first and second scrolls having interfitting vanes adapted to define at least one fluid receiving pocket movable between a radially inner port and a radially outer port upon rotary translation of one scroll relative to the other;

means including at least one rotary shaft, mounting said scrolls for rotation and said rotary translation;

an annular housing affixed to said shaft for rotation therewith and including an inlet through which lubricant may be introduced into said housing;

a stationarily mounted lubricant pick-up tube within said housing and having an open end facing oppositely of the intended direction of rotation of said shaft;

means in fluid communication with said pick-up tube for conveying lubricant picked up by said tube to a point of use within said machine;

a drain in said housing radially inwardly of said open end for allowing lubricant and contaminants therein to exit said housing when said shaft is not being rotated;

a machine housing containing said scrolls, said mounting means, said annular housing and said pick-up tube and further defining a lubricant sump, said inlet being located radially inwardly of said pick-up tube and in fluid communication with said sump; and a cap on said machine housing below said sump, said cap being in fluid communication with said drain and with said sump radially outwardly of said drain.

8. The positive displacement machine of claim 7 wherein said radially inner inlet comprises an annular opening in said annular housing and said pick-up tube is mounted on said machine housing and extends axially into said annular housing through said annular opening.

9. The positive displacement machine of claim 8 wherein the portion of the pickup tube within said annular housing is curved so as to be insertable thereinto through said annular opening and said pick-up tube is further mounted on said machine housing for limited rotation so that said portion may be moved between a radially inner position aligned with said annular opening for assembly purposes and a radially outer position wherein the opening of said pick-up tube is radially outwardly of said drain.

10. A positive displacement machine comprising:

first and second scrolls having interfitting vanes adapted to define at least one fluid receiving pocket movable between a radially inner port and a radially outer port upon rotary translation of one scroll relative to the other;

means including at least one rotary shaft, mounting said scrolls for rotation and said rotary translation;

an annular housing affixed to said shaft for rotation therewith and including an inlet through which lubricant may be introduced into said housing;

a stationarily mounted lubricant pick-up tube within said housing and having an open end facing oppositely of the intended direction of rotation of said shaft;

means in fluid communication with said pick-up tube for conveying lubricant picked up by said tube to a point of use within said machine;

said shaft being hollow and being periodically in fluid communication with said pocket;

a machine housing containing said scrolls and said shaft and having a fluid port;

a transfer tube stationarily mounted in said machine housing and extending into said hollow shaft and being in fluid communication with said fluid port; and means sealing the interface of said shaft and said transfer tube;

said sealing means comprising a flat seal guided into sealing engagement with an end of said shaft by said transfer tube.

11. The positive displacement machine of claim 10 further including a bellows sealed to said machine housing about said fluid port and engaging said flat seal oppositely of said end of said shaft and urging said seal against said end of said shaft.

* * * * *